United States Patent [19]

Mays

[11] Patent Number: 4,787,947

[45] **Date of Patent: * Nov. 29, 1988**

[54] METHOD AND APPARATUS FOR MAKING PATTERNED BELT BONDED MATERIAL

[75] Inventor: Alfred T. Mays, East Windsor, N.J.

[73] Assignee: Chicopee, New Brunswick, N.J.

[ * ] Notice: The portion of the term of this patent subsequent to Dec. 15, 2004 has been disclaimed.

[21] Appl. No.: 65,627

[22] Filed: Jun. 22, 1987

Related U.S. Application Data

[63] Continuation of Ser. No. 661,288, Oct. 17, 1984, abandoned, which is a continuation of Ser. No. 430,309, Sep. 30, 1982, abandoned.

[51] Int. Cl.[4] ..... B32B 31/00

[52] U.S. Cl. ..... 156/160; 156/209; 156/290; 156/311; 156/498; 156/549; 156/555; 156/583.5

[58] Field of Search ..... 156/296, 311, 583.5, 156/498, 181, 324, 459, 555, 495, 549, 160, 499, 209, 441, 290, 309.6

[56] References Cited

U.S. PATENT DOCUMENTS

| | | | |
|---|---|---|---|
| 1,519,239 | 12/1924 | Clay | 156/311 |
| 3,405,674 | 10/1968 | Coates et al. | 264/324 |
| 3,442,740 | 5/1969 | David | 156/311 |
| 3,459,627 | 8/1969 | Vosburgh | 428/198 |
| 3,692,618 | 9/1972 | Dorschner et al. | 428/227 |
| 4,022,643 | 5/1977 | Clark | 156/246 |
| 4,062,918 | 12/1977 | Nakanose | 264/284 |
| 4,488,928 | 12/1984 | Khan et al. | 156/555 |
| 4,548,856 | 10/1985 | Khan et al. | 156/209 |

FOREIGN PATENT DOCUMENTS

| | | |
|---|---|---|
| 1189851 | 4/1970 | United Kingdom . |
| 1237603 | 6/1971 | United Kingdom . |

*Primary Examiner*—Jay H. Woo
*Assistant Examiner*—Timothy W. Heitbrink

[57] ABSTRACT

An apparatus and method for making a strong, high loft, low density nonwoven fabric from a web comprising at least about 5 percent bicomponent fibers, and the fabric formed thereby; wherein the web is superimposed on a first carrier belt, an open mesh belt is superimposed on the web, and the web and belts are caused to travel in a tensioned curvilinear path adjacent a heating means to heat fuse the low melting point component of the conjugate fibers to fibers in the web.

14 Claims, 2 Drawing Sheets

METHOD AND APPARATUS FOR MAKING PATTERNED BELT BONDED MATERIAL

BACKGROUND OF THE INVENTION

This application is continuation of application Ser. No. 661,288, filed Oct. 17, 1984, now abandoned, which is a continuation of application Ser. No. 430,309, filed Sept. 30, 1982, now abandoned.

Honeycomb currently markets an apparatus for heating and fusing thermoplastic fibers in a web. The apparatus is a modification of their thru-air bonder for drying and heat setting fibrous webs. In this apparatus, the web is carried about a rotating drum an heated air is blown onto the web. When starting with a high loft, low density web, such an apparatus yields a very high loft, low density fabric having limited strength. Copending application Ser. No. 412,446 filed Sept. 30, 1982 now abandoned discloses an apparatus and method wherein the web is carried about an open mesh structure which is substituted for the surface of the drum. This apparatus and method produces a unique fabric having patterned regions of even higher loft where fibers are bent out of the plane of the fabric. Another method and apparatus for heat fusing thermoplastic fibers in a web set forth in copending application Ser. No. 430,308 filed Sept. 30, 1982 now abandoned, the web is picked up by a first carrier belt, a second carrier belt is placed on top of the web and the double belt laminate is passed about heated rolls. A fabric made by the double belt bonder has good strength including good cross directional strength but is more dense and not as lofty as fabric made on the Honeycomb apparatus.

SUMMARY OF THE INVENTION

The present invention comprises a method and apparatus for forming a fabric from a web comprising at least five percent low shrink thermoplastic fibers including conjugate fibers and the fabric formed thereby. The method comprises heating a web comprising said low shrink thermoplastic fibers to heat fuse the fibers in the web while the web is tensioned between a first carrier belt and an open mesh belt. When conjugate fibers are used, the method comprises fusing at least the low melting point component of the conjugate fibers. The apparatus of the present invention comprises heating means, a first carrier belt and means for causing said belt to travel in an arcuate path adjacent the heating means, an open mesh belt and means for causing said open mesh belt to travel along an initial path spaced from said first carrier belt and then along said arcuate path. The fabric formed by the method and apparatus of the present invention has a surface pattern on at least one surface thereof and patterned densified regions which are created by the open mesh belt. The fabric has high loft and low density as well as good strength. The open mesh belt may be overlaid by a second carrier belt sandwiching the web and open mesh belt between two carrier belts. The first carrier belt may comprise a second open mesh belt to form a fabric with a pattern on both surfaces. The strength, cushioning, and absorbency of the fabric make it attractive for many end uses including as a diaper facing material. When used as a diaper facing, the fabric may comprise hydrophobic fibers. When only one surface of the fabric is patterned, the fabric displays a greater porosity on the patterned side and a lesser porosity on the unpatterned side providing enhanced wicking from the patterned surface and minimize strike back when used as, for example, a diaper facing.

BRIEF DESCRIPTION OF THE DRAWINGS

FIG. 3B is a fragmentary cross-section along the line 3B—3B of the fabric of FIG. 3 illustrating schematically how the fabric was formed.

FIG. 4B is a fragmentary cross-section along line 4B—4B of the fabric of FIG. 4, illustrating how the fabric was formed.

DESCRIPTION OF THE DRAWINGS

The present invention comprises an apparatus and a method for making a fabric from a web comprising low shrink thermoplastic fibers, including conjugate fibers and the fabric formed thereby. It is preferred to employ sheath/core conjugate fibers of polyethylene/polyester respectively. Sheath/core fibers of polyethylene/polypropylene may also be used, as well as low shrink thermoplastic such as Eastman 4BC crystalline copolyester monofil. Either eccentric or concentric sheath/core fibers can be employed.

Figure 1:
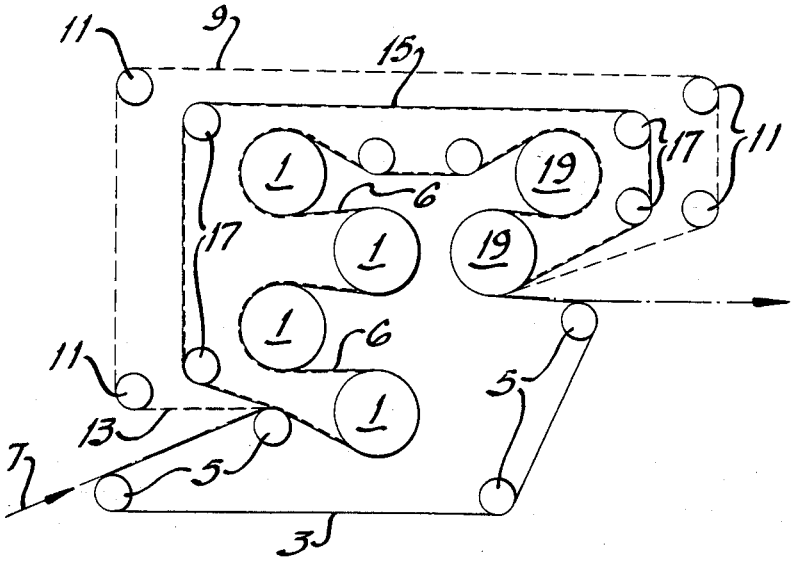
FIG. 1 is a schematic side view of one embodiment of the apparatus and method to the present invention.

FIG. 1 illustrates, schematically, a side view of one embodiment of the apparatus of the present invention wherein the heating means 1 comprises heated rolls or steam cans. Alternate heating means, such as a Honeycomb apparatus, may be used, including any other heating means where the belts can travel in tensioned arcuate paths adjacent the heating means.

In the method shown, a first endless carrier belt 3, is provided having means 5, for causing said first endless carrier belt to travel in a curvilinear path 6, adjacent the heating means. Web 7 is superimposed on said first carrier belt 3. In its broadest aspect, the present invention includes the surface of a Honeycomb type dryer as the first endless carrier belt.

According to the present invention, an open mesh belt 9 is superimposed on the web prior to heating. The open mesh structure may comprise an endless belt provided with means 11 for causing said open mesh belt to travel along an initial path 13 spaced from said first endless carrier belt, and then along the curvilinear path 6 around the heating means. A second endless carrier belt 15 may be superimposed on top of the open mesh structure 9. When a second endless carrier belt is used, the open mesh belt may comprise belt segments. The second endless carrier belt is provided with means 17 for causing said belt to travel along path 6. The conjugate fibers in the web, when heated, fuse to fibers in the web to provide a strong, high loft, low density fabric.

In a preferred embodiment of the method of the present invention the web is cooled before it is separated from the first carrier belt and the open mesh belt. To facilitate cooling, the belts may be passed around at least one cooling roll shown at 19 in FIG. 1. By maintaining the web between the belts until the web is cooled, the methd avoids the less in cross directional strength due to drafting as a web is removed from a roll on one carrier belt. Also the use of the two belts prevents sticking of the heated thermoplastic fibers of the web to the rolls and permits rapid handling of the web while heated, including immediately passing the web about cooling rolls.

Figure 2:
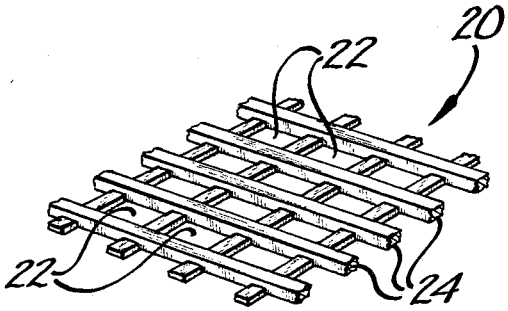
FIG. 2 is a plan view of a portion of the open mesh belt for use according to the present invention.

FIG. 2 illustrates a portion of an open mesh belt 20 used in the present invention. The open areas 22 and depth 24 of the open mesh belt allow the web to maintain its high loft and low density through the heat bonding procedure. The depth 24 of the open mesh belt maintains the distance between the tensioned first and second carrier belts so that the web is not crushed therebetween. The depth of the open mesh belt and the degree of open area 22 determine the loft of the final fabric material.

Figure 3:
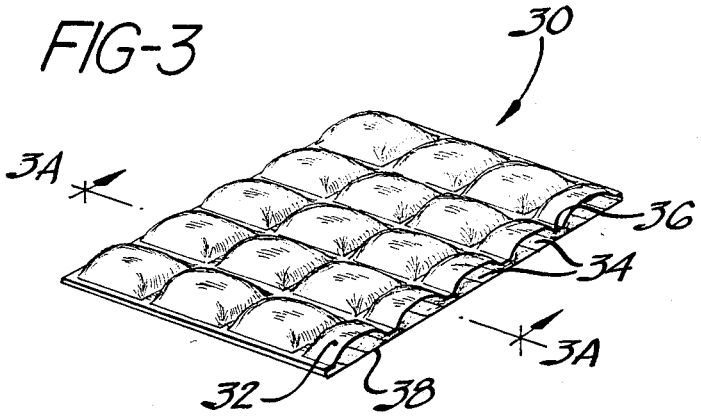
FIG. 3 is a perspective view of one embodiment of a fabric according to the present invention.
Figure 3A:
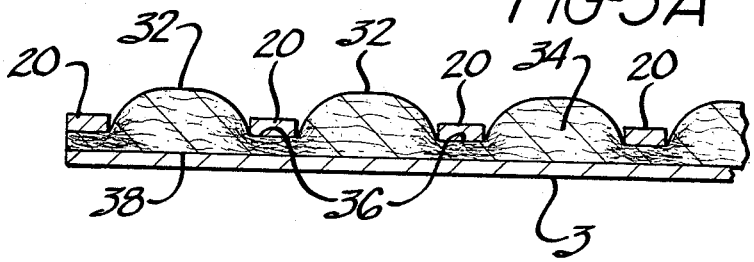
FIG. 3A is a fragmentary section of the fabric of FIG. 3 illustrating schematically how the fabric was formed.

FIG. 3 illustrates a fabric formed according to the method of the present invention. As shown in FIG. 3A, the fabric is formed using one open mesh structure as seen in FIG. 2. The fabric shown generally at 30 has one surface thereof 32 which is patterned. The surface 32 consists of regions 34 of high loft, low density and good porosity and regions 36 that are densified between the open mesh structure 20 and carrier belt 3. Surface 38 formed against belt 3 is smooth. The fabric has a porosity differential from the surface 32 to the opposite surface 38 and hence may be used advantageously in many applications, for instance, as a diaper facing fabric. The fabric formed according to the method of the present invention exhibits a high loft, lower density and better strength than fibers formed on a double belt bonder as described in copending application (CHIC 654) or with a thru-air bonder.

In the following example, samples of a web formed with a dual rotor were fusion bonded according to the methods listed.

EXAMPLE 1

| | THRU-AIR | PRESENT INVENTION 3 mesh | PRESENT INVENTION 6.8 mesh | DOUBLE BELT |
|---|---|---|---|---|
| Weight oz/yd.$^2$ | 3.0 | 3.1 | 3.2 | 3.2 |
| Bulk inch | .066 | .060 | .056 | .042 |
| Density gm/cm$^3$ | .0613 | .0694 | .0756 | .1002 |
| Tensile lb | 1.0 | 1.5 | 1.8 | 1.8 |
| Tenacity lb./inch/100/grains | .08 | .11 | .13 | .13 |
| Absorbency % | 1329 | 1155 | 1062 | 896 |
| Rate sec | 3.1 | 3.1 | 4.3 | 9.9 |
| Softness | | | | |
| MD gram | 135.5 | 133 | 152.1 | 162.7 |
| CD gram | 88.1 | 112 | 129.7 | 162.8 |

As can be seen, the fabric formed according to the present invention maintains a high bulk and low density similar to that of the thru-air bonder but has a strength approximately that of a double belt bonded fabric.

Webs used in the present invention may be prepared by air laying or carding of the fibers. The weight of the web may range from 0.3 to 5 ozs./yd.$^2$. The present invention preferably utilizes a conjugate fiber with an outer sheath of thermoplastic material. In a most preferred embodiment, the fiber is capable of self-crimping when heated and the method involves heating to effect autogenous bonding of the web and self-crimping of the thermoplastic fibers. The web may further comprise synthetic wood pulp, wood pulp, cellulosic or other fibers. The percentage of the low shrink thermoplastic fibers in the web may vary from five to 100 percent. The open mesh belt is preferably formed of a material with easy release properties and/or good heat transmission. The structure of the open mesh belt may vary according to the desired properties of the fabric; the more open mesh yielding more bulk, softness and absorbency; the tighter mesh yielding higher tensile strength as set forth in the following Example.

EXAMPLE 2

| Mesh = | 3.0 | 4.7 | 5.3 | 5.8 | 6.0 | 6.8 |
|---|---|---|---|---|---|---|
| Weight oz/yd.$^2$ | 3.1 | 3.2 | 3.1 | 3.3 | 3.1 | 3.2 |
| Bulk inch | .060 | .062 | .060 | .058 | .053 | .056 |
| Density gm/cm$^3$ | .0694 | .0682 | .0694 | .0758 | .0786 | .0756 |
| Tensile MD lb. | 1.5 | 1.7 | 1.5 | 1.8 | 1.8 | 1.8 |
| Tenacity lb/inch/100 grains | .11 | .12 | .11 | .12 | .13 | .13 |
| Absorbency % | 1155 | 1219.1 | 1155 | 1070 | 1038 | 1062 |
| Rate sec | 3.1 | 2.9 | 3.1 | 4.0 | 3.8 | 4.3 |
| Softness: | | | | | | |
| MD gram | 133 | 162.6 | 132.7 | 143.9 | 154.9 | 152.1 |
| CD gram | 112 | 109.5 | 112.4 | 138.6 | 123.1 | 129.7 |

Figure 4:
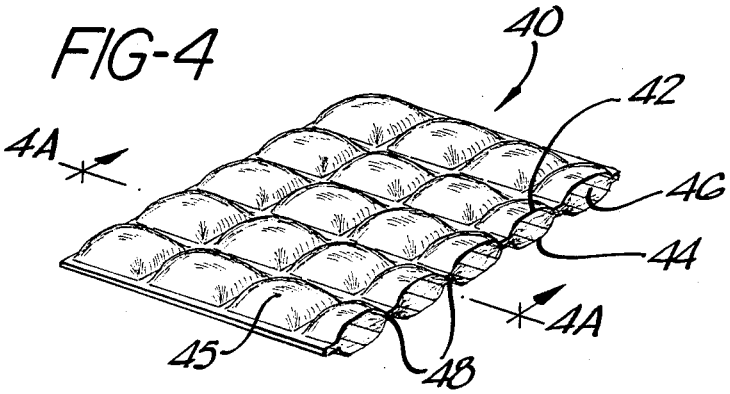
FIG. 4 is a perspective view of another embodiment of a fabric according to the present invention.
Figure 4A:
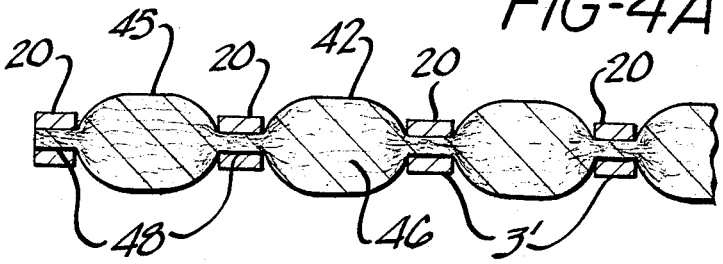
FIG. 4A is a fragmentary section of the fabric of FIG. 4 illustrating schematically how the fabric was formed.

FIG. 4 illustrates another fabric formed by the method and apparatus of the present invention. As shown in FIG. 4A, another open mesh belt is substituted for the first carrier belt or interposed between the first carrier belt and the web. The fabric is shown generally at 40. Both surfaces 42 and 44 of the fabric have a surface pattern. As the surfaces 42 and 44 are formed by means of separate open mesh belts 3' and 9, they need not have the same pattern and may be formed by different open mesh belts and belts out of registry. Each of the surfaces 42 and 44 have regions 46 of high bulk and low density and good porosity and regions 48 that are densified. Though the fabrics made according to the method of the present invention have many uses, they are particularly suited for those end uses requiring strength, bulk and absorbency.

I claim:

1. A method of producing a fused nonwoven fabric comprising thermoplastic fibers, said method comprising:

(a) superimposing a high loft, low density fibrous web comprising at least 5 percent thermoplastic fibers on a first endless carrier belt;

(b) superimposing a second endless carrier belt on said web so as to form a two belt laminate with said web sandwiched between the first and second endless carrier belts;

(c) at least one of said carrier belts having an open mesh structure formed by spaced, intersecting mesh elements so as to define open areas between said mesh elements;

(d) directing said two belt laminate to travel in a tensioned path consecutively around substantial portions of first and second heated rolls, which are offset from each other and spaced apart a sufficient distance to avoid a compression nip between said first and second heated rolls, the peripheral surfaces of said first and second heated rolls cooperating to provide a portion of said path thereby said two belt laminate travels out of contact with said first and second heated rolls, so as to initially apply heat to a first side of said web as said two belt laminate is directed around said first heated roll and thereby fuse at least the thermoplastic fibers adjacent to said mesh elements to fibers adjacent the first side thereof and to thereafter apply heat to a second side of said web as said two belt laminate is directed around said second heated roll and thereby fuse at least the thermoplastic fibers adjacent to said mesh elements to fibers adjacent the second side thereof, so as to form a web having a patterned surface defining regions corresponding to the open areas between said mesh elements that substantially maintain the high loft and low density of the web that are bordered by fused regions corresponding to the mesh elements; and (e) cooling the two belt laminate after it has traveled around the first and second heated rolls so as to cool the fibers in the web sandwiched between the first and second endless carrier belts.

2. A method as set foth in claim 1, wherein said directing step is performed by transporting said two belt laminate around a third heated roll and a fourth heated roll.

3. A method as set forth in claim 2, wherein said second roll is horizontally and vertically offset from said first roll, said third roll is spaced vertically above said first roll, and said fourth roll is spaced vertically above said second roll, whereby said two belt laminate is transported along a serpentine path wherein the first side of said web is heated by said first and third rolls and the second side of the web is heated by said second and fourth rolls.

4. A method as set forth in claim 1, wherein a further carrier belt is superimposed on said open mesh carrier belt to form a three belt laminate which is directed to travel in said path.

5. A method as set forth in claim 1, wherein said first and second carrier belts both have an open mesh structure.

6. A method as set forth in claim 5, wherein the mesh elements of the first carrier belt are aligned with the mesh elements of the second carrier belt as said two belt laminate travels along said path.

7. A method as set forth in claim 1, wherein said cooling step is performed by causing said two belt laminate to travel past a cooling element.

8. Apparatus for forming a nonwoven fabric comprising thermoplatic fibers, said apparatus comprising:

(a) a frame;

(b) first and second heated rolls rotatably mounted to said frame in offset relationship to each other, said rolls being spaced apart a sufficient distance to avoid a compression nip between said first and second rolls;

(c) a first endless carrier belt means mounted to said frame for travel in a path consecutively around substantial portions of said first and second heated rolls;

(d) a second endless carrier belt means mounted to said frame for travel along said path around substantial portions of said first and second heated rolls adjacent to said first belt means;

(e) at least one of said carrier belt means having an open mesh structure formed by spaced, intersecting mesh elements so as to define open areas between said mesh elements;

(f) means for superimposing a fibrous web, comprising at least 5 percent thermoplastic fibers, onto said first belt means so that said first and second belt means form a two belt laminate with said web sandwiched therebetween, said two belt laminate being caused to travel in said path consecutively around a substantial portion of said first heated roll to initially apply heat to a first side of said web and thereby fuse at least the thermoplastic fibers adjacent to said mesh elements to fibers adjacent the first side thereof and then around a substantial portion of said second heated roll to apply heat to a second side of said web and thereby fuse at least the thermoplastic fibers adjacent to said mesh elements to fibers adjacent the second side thereof, so as to form a web having a patterned surface defining regions corresponding to the open areas between said mesh elements that substantially maintain the high loft end and low density of the web that are bordered by fused regions corresponding to the mesh elements;

(g) the peripheral surfaces of said first and second heated rolls cooperating to provide a portion of said path whereby said two belt laminate travels out of contact with said first and second heated rolls; and (h) means for cooling said two belt laminate after it has travelled around said first and second heated rolls to cool the fibers in the web sandwiched between said first and second endless carrier belts.

9. Apparatus as set forth in claim 4, wherein said cooling means comprises at least one cooling roll.

10. Apparatus as set forth in claim 4, wherein third and fourth heated rolls are mounted to said frame in offset relationship to each other, said third and fourth rolls being spaced apart a sufficient distance to avoid a compression nip between said first and second rolls.

11. Apparatus as set forth in claim 1, wherein said third roll is spaced vertically above said first roll and said fourth roll is spaced vertically above said second roll.

12. Apparatus as set forth in claim 4, wherein a further endless carrier belt means is mounted to said frame for travel along said path in superimposed relationship upon the carrier belt means having said open mesh structure.

13. Apparatus as set forth in claim 4, wherein said first and second endless belt carrier means both have an open mesch structure defined by intersecting mesh elements.

14. Apparatus as set forth in claim 13, wherein the mesh elements of said first endless belt carrier means are aligned with the mesh elements of said second endless belt carrier means as said first and second endless belt carrier means travel along said path.

* * * * *

UNITED STATES PATENT AND TRADEMARK OFFICE

CERTIFICATE OF CORRECTION

PATENT NO. : 4,787,947

DATED : November 29, 1988

INVENTOR(S) : Alfred T. Mays

It is certified that error appears in the above-identified patent and that said Letters Patent is hereby corrected as shown below:

Claim 1, column 5, line 16, "thereby" should read --whereby--.

Claim 13, column 6, line 61, "mesch" should read --mesh--.

Signed and Sealed this

Twenty-ninth Day of August, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,787,947

DATED : November 29, 1988

INVENTOR(S) : Alfred T. Mays

It is certified that error appears in the above-identified patent and that said Letters Patent is hereby corrected as shown below:

Claim 9, column 6, line 44: "claim 4" should read --claim 8 --.

Claim 10, column 6, line 46: "claim 4" should read -- claim 8 --.

Claim 11, column 6, line 50: "claim 1" should read -- claim 10 --.

Claim 12, column 6, line 51: "claim 4" should read -- claim 8 --.

Claim 13, column 6, line 59: "claim 4" should read -- claim 8 --.

Signed and Sealed this

Twelfth Day of December, 1989

*Attest:*

JEFFREY M. SAMUELS

*Attesting Officer*

*Acting Commissioner of Patents and Trademarks*